US008180077B1

(12) United States Patent
Slaughter

(10) Patent No.: US 8,180,077 B1
(45) Date of Patent: May 15, 2012

(54) MEDICAL GRADE STEREO SYSTEM

(76) Inventor: Stephen M. Slaughter, Allen, TX (US)

( * ) Notice: Subject to any disclaimer, the term of this patent is extended or adjusted under 35 U.S.C. 154(b) by 582 days.

(21) Appl. No.: 12/427,937

(22) Filed: Apr. 22, 2009

Related U.S. Application Data

(60) Provisional application No. 61/046,867, filed on Apr. 22, 2008.

(51) Int. Cl.
*H04R 1/00* (2006.01)

(52) U.S. Cl. ..... 381/189

(58) Field of Classification Search ..... 381/189, 381/77, 334, 388; 701/1; 455/556.1, 569.1, 455/550.1, 404.1, 344, 575.1, 186.1, 188.1, 455/559, 301, 128, 349; 361/56, 724, 679.3, 361/679.56, 679.09, 42; 336/84 R, 212, 336/183; 324/457, 13 R, 551; 607/2, 36, 61, 60, 34, 31
See application file for complete search history.

*Primary Examiner* — Zandra Smith
*Assistant Examiner* — Lawrence Tynes, Jr.
(74) *Attorney, Agent, or Firm* — Michael Shimokaji, Esq.

(57) ABSTRACT

A medical grade stereo system is disclosed. The stereo system may include a housing with faceplates where a user interface and connectors mounted to the faceplates form fully sealed interfaces sealing the housing interior from the environment. A shielding enclosure and shielded components provide a system that may limit radio frequency emissions. A power supply supplying power to the system may limit current leakage to less than 300 microamperes. A hospital grade A/C power cord and electrical plug connect the system to a room's electrical line. Additionally, the system may include an internally formed interface for a satellite tuner adaptor cable connection connecting a satellite tuner to a stereo receiver hub entirely within the housing and enclosure.

17 Claims, 4 Drawing Sheets

MEDICAL GRADE STEREO SYSTEM

RELATED APPLICATIONS

This application claims the benefit of priority from U.S. Provisional application 61/046,867 filed on Apr. 22, 2008. This application is related to concurrently filed U.S. Non-provisional application No. 12/427,943 filed on Apr. 22, 2009.

BACKGROUND OF THE INVENTION

The present invention generally relates to operating room equipment, and more particularly, to a medical grade stereo system.

A study published in JAMA in 1994 demonstrated increased performance and decreased stress in surgeons when they listen to music that they enjoy. Since this study was published, stereos are seeing increasing prevalence in some operating rooms.

According to some operating room environmental standards, electrical devices employed in an operating room environment should not emit electrical and/or radiofrequency signals that interfere with the function and operation of other equipment. It is known that where some prior art electrical devices produce an excessive current leakage, the likelihood of a burn to a patient may occur during a short circuit.

Medical devices should also conform to infection control capabilities for cleaning and disinfection. Additionally, while not necessarily dictated by environmental standards, one may want to control the use of music in an operating room as its presence may interfere with the audibility of patient monitors and alarms, for example, a pulse oximeter and an apnea alarms which produce audio signals when in operation.

It is known to use existing residential or commercial grade audio systems and mobile audio components in an operating room environment. Mobile audio components may be housed within the line isolation electrical panel which is located about the periphery of the operating room or may be free-standing and portable in their factory manufactured condition where power is obtained from a power supply mounted outside the operating room. Stereos built into the line isolation electrical panel are fixedly mounted into the walls and, thus are not freestanding. In set ups where the power supply is remotely mounted, the wires supplying a 12 volt DC current may be routed through the walls. Stereos connected to a remote power supply may sometimes use an ungrounded chassis of greater than 10 volts. Ungrounded chassis are known causes of electrocution by short circuiting. Additionally, personnel may use different mobile audio devices each requiring their own electrical connections and each of which may not take into account the operating room environment.

For instance, one example of a medical grade electrical device is a video router with an integrated audio function for hearing audio files associated with the video output. Currently known video routers do not typically incorporate a radio tuner. Additionally, video routers may include multiple pieces of equipment which are not typically housed in a single enclosure.

It is also known to augment a stereo device in the operating room with satellite feed capabilities. This may require adding another piece of equipment to the existing equipment with external adaptor connections, in order for the satellite radio signal to be decoded by the satellite radio tuner. Additionally, bringing in one's own, non-medical grade equipment may overlook the safety of an operating room environment by neglecting the need for safety in connecting a reliable A/C power cord into the room's electrical line.

As can be seen, there is a need for a medical grade stereo system conforming to operating room environmental standards, and specifically, one that may integrate multiple audio sources into a single package.

SUMMARY OF THE INVENTION

In one aspect of the present invention, a medical grade stereo system, comprises a housing; a stereo receiver housed with the housing; a shielding enclosure mounted around the housing and configured to obstruct radio frequency emissions from the stereo receiver; and a shielded power supply connected to the stereo receiver configured to permit less than 300 microamperes of current leakage from leaking from the stereo system.

In another aspect of the present invention, a medical grade stereo system, comprises a housing including a rear face plate; a stereo receiver housed with the housing; and a satellite radio tuner connected to the stereo receiver; an F-type connector mounted to the rear face plate; an adaptor cable housed within the housing connected to the F-type connector; and a subminiature version B connector interface housed within the housing connecting the satellite radio tuner to the adaptor cable.

In another aspect of the present invention, a medical grade stereo system, comprises a housing including a front face plate and a rear plate; a stereo receiver mounted into the housing for transmitting audio signals from a plurality of audio media devices; a user interface mounted onto the front face plate for user operation of the stereo receiver; a face plate cover mounted onto the user interface wherein the face plate cover seals the user interface from the environment; a power supply mounted into the housing for supplying power to the stereo receiver and configured to limit current leakage from the stereo system to less than 300 microamperes; a shielding enclosure surrounding the housing configured to limit radio frequency emissions from flowing out of the medical grade stereo system; a plurality of audio component connectors mounted onto the housing each forming respective fully sealed interfaces with the housing for connecting auxiliary audio media players to the stereo receiver; and a shielded strain relief connector mounted on the rear plate forming a fully sealed interface at the rear plate.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a medical grade stereo system satisfying environmental standards for use in an operation room environment. In general, the stereo system according to the present invention can be utilized as a mobile unit capable of being moved around to a desired location in an operating room, however, it will be understood that in other exemplary embodiments, the stereo system may be installed in a wall location within the operating room.

Figure 1:
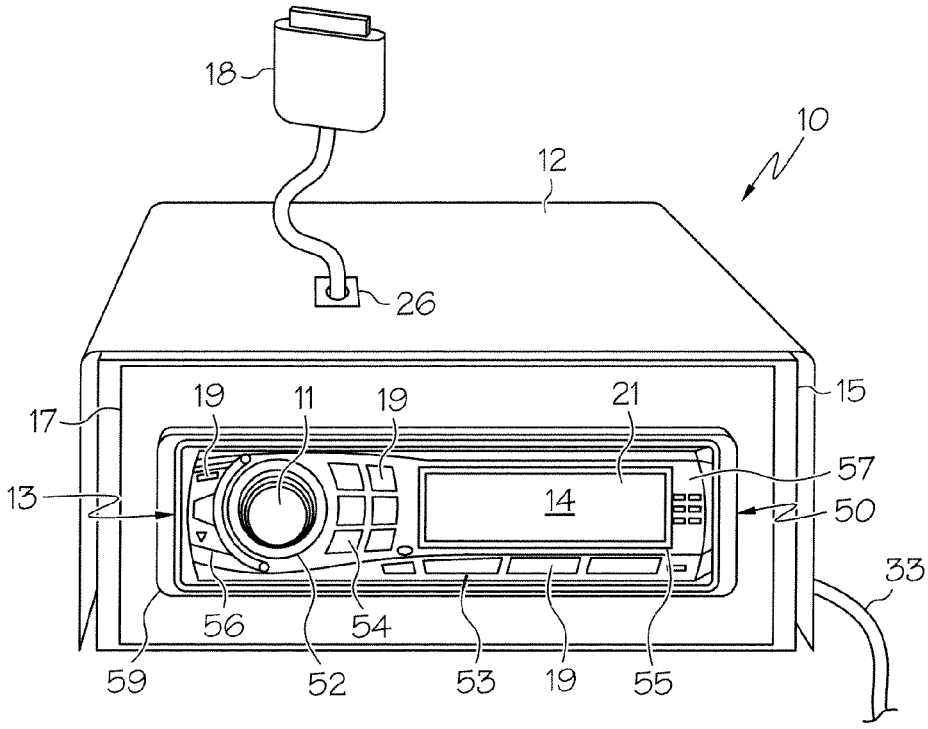
FIG. 1 is a front perspective view of a medical grade stereo system according to an exemplary embodiment of the present invention.
Figure 2:
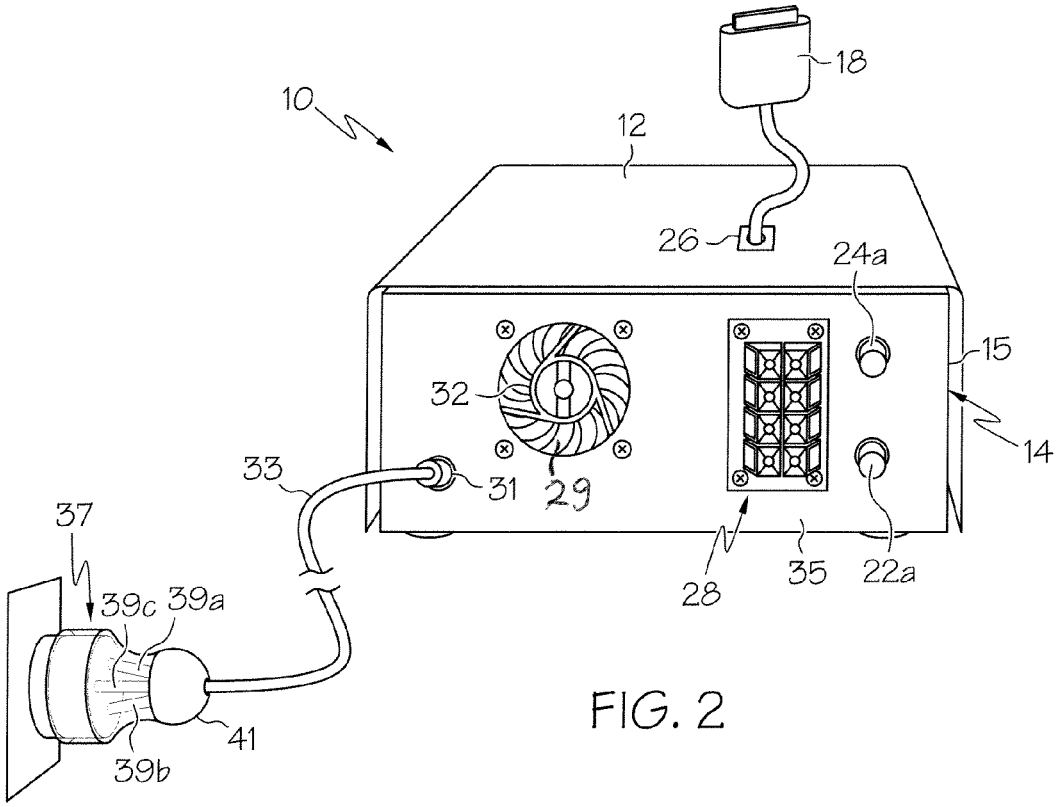
FIG. 2 is a rear perspective view of the stereo system shown in FIG. 1.
Figure 3:
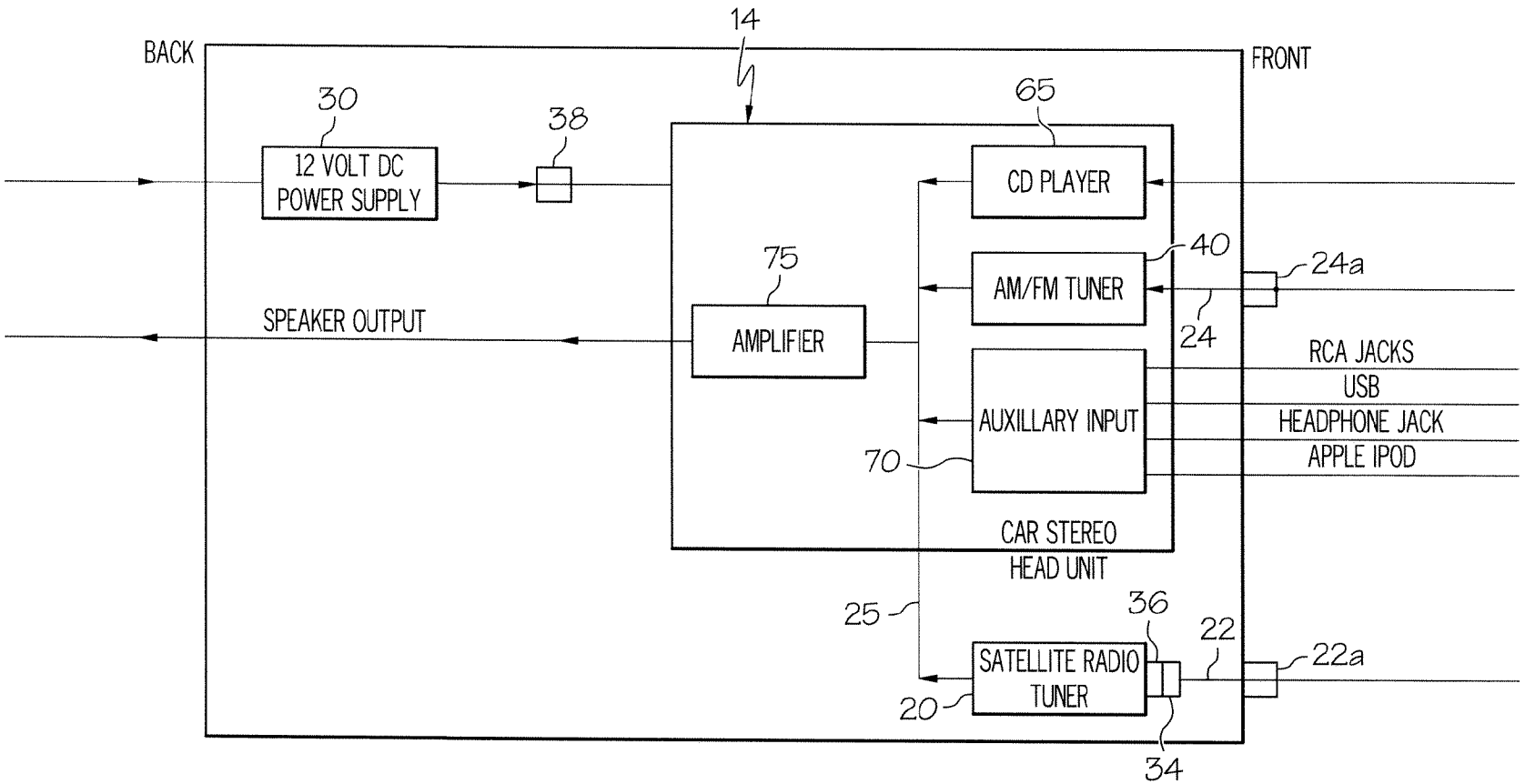
FIG. 3 is a schematic depicting an internal configuration according to an exemplary embodiment of the present invention.
Figure 4A:
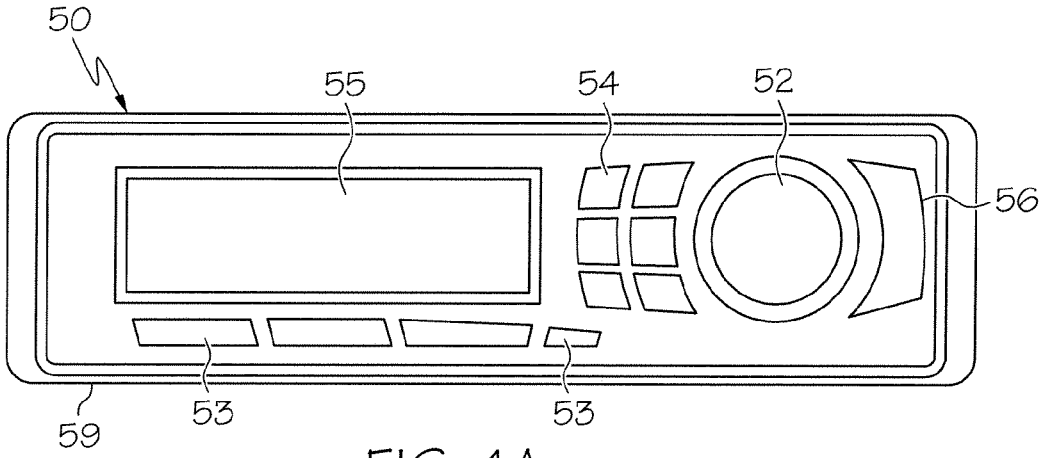
FIG. 4A is a rear view of a faceplate used in accordance to an exemplary embodiment of the present invention.
Figure 4B:
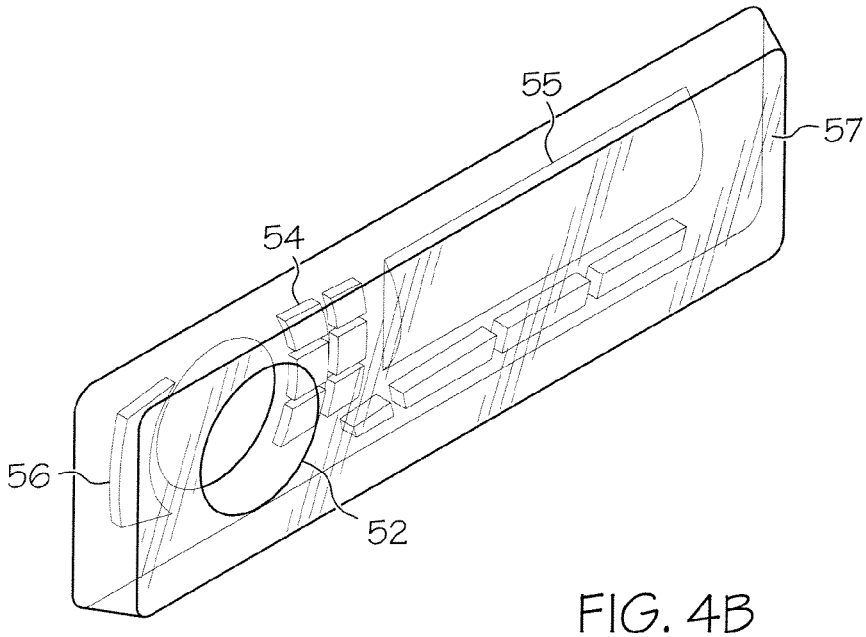
FIG. 4B is a front perspective view of the faceplate shown in FIG. 4A.
Figure 4C:
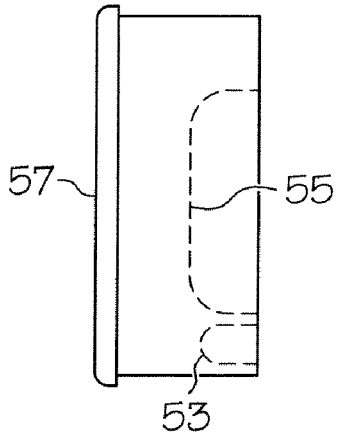
FIG. 4C is a left end view of the faceplate shown in FIG. 4A.
Figure 4D:
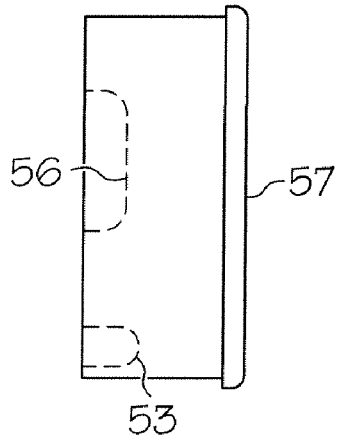
FIG. 4D is a right end view of the faceplate shown in FIG. 4A.

Referring to FIGS. 1-3, an exemplary embodiment of a medical grade stereo system 10 is shown. The stereo system 10 may generally include a stereo receiver hub 14, a shielding enclosure 12, a housing unit 15, a faceplate cover 50, and a power supply 30.

The shielding enclosure 12 may be made from a customized form of sheet metal adaptable to fit around a housing unit 15 of various sizes. While the shielding enclosure 12 is shown in this exemplary embodiment as including 3 sides with an open bottom, it will be understood that all sides save the front of the stereo system 10 may be enclosed with appropriate openings permitting ventilation and wiring connections formed in the enclosure.

The housing unit 15 may include a front plate 17 defining the position of installation of the user interface 13 and shielding the internal components of the stereo receiver hub 14 behind the user interface 13 from the environment. The rear of the housing 15 may include a rear plate 35 providing a mounting wall for various connectors. The housing unit 15 may further include a base portion (not shown) for supporting the carriage of the internal components.

The stereo receiver hub 14 may include a user interface 13 including a plurality of buttons 19, a dial 11, and a display screen 21. It will be understood that buttons 19 may describe any depressible device on the user interface and that buttons 19 may perform various individual respective functions.

Electrical and air contaminant mitigation can be achieved by use and placement of the input power and ventilation systems in the stereo system 10. A cooling fan 32 may be located on the rear plate 35 pushing air directly in to the housing 15 where heated air can be exhausted through ventilation ports (not shown) on the bottom or side of the housing arranged to minimize the risk of splashing liquids from entering inside the system 10. A removable filter medium 29 may be inserted into the cooling fan 32 to further aid in the mitigation of airborne contaminants. The rear plate 35 may interface with various connectors fully sealing respective connector interfaces to prevent contaminants from flowing in or out of the housing 15 interior. It will be understood of course, that the cooling fan 32 will not be fully sealed as to permit airflow into the housing 15 interior.

The power supply 30 may receive alternating current from a power source through a hospital grade A/C cord 33. The alternating current may be fed from the A/C cord 33 into the power supply with the assistance of a fully shielded strain relief connector 31 connected to the housing 15 at the rear plate 35. On the other end of the hospital grade A/C cord 33 is a hospital grade electrical plug 37 connectable to a wall power socket. The hospital grade electrical plug 37 may include a transparent housing 41 permitting visibility to the interior wires 39*a*, 39*b*, and 39*c*. One feature of the hospital grade electrical plug 37 is that visible confirmation of proper grounding of the system 10 to the grounding prong (not shown) can be achieved. It will also be understood that the hospital grade electrical plug 37 and the A/C power cord 33 should have sufficient assembly integrity, cable strength, and durability to meet specifications of Underwriters Laboratories (UL) and the Canadian Standards Association (CSA).

A 12 volt DC power may be supplied from the power supply 30 to the radio receiver hub 14 through a pin and socket connector 38 such as a Molex™ brand connector. The power supply 30 may be mounted within the housing 15 so that it is separated by a minimum of 4 mm from other components or may instead, be shielded within the housing 15 to prevent contact with other components. The shielding enclosure 12 outside the housing 15 may thus, obstruct radio frequency emissions flowing into or out of the housing 15 and may additionally work in tandem with the strain relief connector 31 and the mounting configuration of the power supply 30 to aid in obstructing current leakage. The power supply 30 may operate with a current leakage of less than 300 microamperes. Thus, radio frequency emissions and electrical leakage may be kept to a safe minimum level.

The system 10 may interconnect various integrated audio source components to provide an integrated multi-audio source unit while contributing to a safe operating room environment. The stereo receiver hub 14 may include, for example, built-in components such as an AM/FM tuner 40, a CD player 65, and an auxiliary input hub 70, each connected to an amplifier 75 for amplifying respective signals as necessary. The stereo receiver 14 may be configured to receive both analog and digital radio transmissions and satellite as well as, over the air transmissions.

Satellite broadcasts may be desired for receipt by a user, in which case, the auditory experience may benefit from including a satellite radio tuner 20. The satellite radio tuner 20 and its associated connections may be employed internally within the system 10 in connection with the stereo receiver hub 14 and connected in turn to the amplifier 75. The satellite radio tuner 20 may receive a satellite radio signal feed from a female F-type connector 22*a* mounted on the rear plate 35 connecting an adapter cable 22 to the satellite radio tuner 20 via a subminiature version B (SMB) plug 34 interfacing with another SMB plug 36. Thus, the SMB (34; 36) interface may be connected to the adapter cable 22 entirely within the housing 15 interior. The satellite radio signal may then be transmitted from the satellite radio tuner 20 into the stereo receiver 14 through a satellite audio signal cable 25.

When over the air broadcasts, such as AM and FM signals are desired, an over the air radio tuner 40 may be employed. Radio signals may be input from an antenna source through an F-type connector 24*a* mounted on the rear face of the housing 15 through an adapter cable 24, such as a RG-6 coaxial cable or a cable rated for 75 ohm resistance.

The auxiliary input hub 70 may be utilized to provide a variety of media connections. For example, a portable media player adaptor 18 for Apple® media players such as an iPod®, an iPhone®, or other Apple® media playing device, may fed through the housing 15 with the aid of a strain relief 26 and connected to the auxiliary input hub 70 so that the stereo receiver hub 14 provides power to an attached portable media player device (not shown) while simultaneously receiving audio signal feeds from the device. It will be understood that while an Apple® iPod® 30 pin adaptor is shown, other portable media players and their suitable adaptors, such as USB plugs, RCA connectors, and 3.5 mm stereo tip, ring, sleeve jack plugs may be employed in the system 10. Other auxiliary input mechanisms such as RCA jacks, USB connectors, and head phone jacks may be equipped as necessary to provide connection to other media devices integrated into the system 10. Speaker terminals 28 may be mounted to the rear plate 35 and may also be directly connected to the stereo receiver 14 providing an audio signal output from the stereo receiver 14.

Referring specifically to FIGS. 1 and 4A-4D, the faceplate cover 50 may be attached to the front of the user interface 13. The faceplate cover 50 may be made from an injection molded flexible, clear, and waterproof plastic. The faceplate cover 50 may include a front surface 57, a sealing edge 59, a sealing ring 52 and molded pockets 53; 54; 55; and 56. The sealing edge 59 may extend around the periphery of the user interface 13 to seal any gaps between the user interface 13 and the front plate 17. The sealing ring 52 may permit the dial 11 to protrude from the front surface 57 and seals the dial 11 from the rest of the user interface 13 while allowing the dial 11 to be turned as needed. The front surface 57 may span the entirety of the front of the faceplate cover 50 (except about the circumference of the sealing ring 52) with a smooth, non-porous and flexible surface extending to the periphery of the sealing edge 59.

Referring specifically now to FIGS. 4A-4D, a plurality of molded pockets 53; 54; 55; and 56 may be formed on the interior of the faceplate cover 50 to enclose and seal respective elements on the user interface 13. In the exemplary embodiment shown, a molded pocket 55 may be formed to enclose the display screen 21, and molded pockets 53; 54; and 56 may be formed to enclose buttons 19 in their various shapes. The molded pocket 55 may be formed to seal the display 21 from the rest of the user interface 13 while providing visibility to the display 21 underneath the front surface 57. The molded pockets 53; 54; and 56 may be formed to match the periphery of the button 19 they are associated with sealing the buttons 19 from the rest of the user interface 13 while providing a flexible interface for the user to depress respective buttons.

As a user wishes to operate the stereo system 10, the user may depress the button 19 associated with powering on by pressing directly above it on the front surface 57. Switching between an analog radio signal, a satellite radio signal, a portable media player signal, raising the volume, and selecting speaker output may be accomplished by looking through the clear front surface 57 and depressing the appropriate button 19 or activating the appropriate dial 11 function. The dial 11 may provide multiple functions such as tuning into an analog or satellite signal. The sealing ring 52 allows the user to twist the dial 11 freely without fear of liquids or other contaminants trickling off the hand or gloves into the radio receiver 14 and conversely, without fear that contaminants from the radio receiver or user interface 13 will surface. The molded pockets 53; 54; 55; and 56 may catch any contaminants emanating from the housing 15 interior that leak out onto the user interface 13 surface and mitigate movement across the user interface 13. Additionally, any contaminants that may arise on the user interface 13 surface may also encounter the sealing edge 59 on a contaminant's movement toward the operating room environment. Since the operating room environment can sometimes include splashing from various liquids, the exterior of the stereo system 10 may also encounter contaminants requiring quick cleaning and disinfection. Thus, as a user wishes to clean and sterilize the stereo system 10 interface area, one may appreciate that the user may accomplish cleaning/disinfection across the smooth, non-porous surface 57 with a single wiping motion.

While embodiments above have been described in the context of a mobile self-contained unit, it will be also understood that the stereo system 10 may be integrated into a portable larger piece of equipment such as anesthesia workstation where the a cable 33 may be run from a power supply in the operating room walls. Thus, in a portable workstation, volume emanating from the stereo system 10 may be localized to minimize interference with other operating room machines that emanate an audible signal.

It should be understood, of course, that the foregoing relates to exemplary embodiments of the invention and that modifications may be made without departing from the spirit and scope of the invention as set forth in the following claims.

I claim:

1. A medical grade stereo system, comprising:
a housing;
a stereo receiver housed with the housing;
a shielding enclosure mounted around the housing and configured to obstruct radio frequency emissions from the stereo receiver;
a power supply connected to the stereo receiver wherein the shielding enclosure and the power supply are configured to permit less than 300 microamperes of current leakage from leaking from the stereo system; and
a hospital grade electrical plug connected to a hospital grade A/C cord connected to the power supply wherein the electrical plug is configured for connection to a grounded wall socket.

2. The medical grade stereo system of claim 1 further comprising a shielded strain relief connector connecting the A/C cord to the power supply.

3. The medical grade stereo system of claim 1, further comprising a satellite radio tuner connected to the stereo receiver wherein the satellite radio tuner is disposed entirely within the housing.

4. The medical grade stereo system of claim 1, further comprising a portable media player adaptor connected to the stereo receiver.

5. The medical grade stereo system of claim 4, wherein the stereo receiver is configured to provide power to a portable media player through the portable media player adaptor.

6. The medical grade stereo system of claim 4, wherein the portable media player adaptor is a 30 pin connector.

7. The medical grade stereo system of claim 1 further comprising a plurality of speaker terminals mounted to the rear of the housing and directly connected to the stereo receiver.

8. The medical grade stereo system of claim 1 further comprising a fan and a removable filter medium attached to the fan configured to trap airborne contaminants.

9. The medical grade stereo system of claim 1, further comprising an analog radio adaptor cable connected to the stereo receiver for transmitting analog radio signals to the stereo receiver.

10. A medical grade stereo system, comprising:
a housing including a rear plate;
a stereo receiver housed with the housing;
a satellite radio tuner connected to the stereo receiver;
an F-type connector mounted to the rear plate;
an adaptor cable housed within the housing connected to the F-type connector; and a subminiature version B connector interface housed within the housing connecting the satellite radio tuner to the adaptor cable.

11. The medical grade stereo system of claim 10, further comprising a plurality of audio source component systems connected to the stereo receiver.

12. The medical grade stereo system of claim 11 wherein the plurality of audio source component systems each include respective cables and connector interfaces mounted on the rear face plate connecting the cables to the stereo receiver.

13. The medical grade stereo system of claim 12 wherein the connector interfaces are fully sealed at the rear plate.

14. The medical grade stereo system of claim 10 further comprising a shielding enclosure surrounding the housing.

15. The medical grade stereo system of claim 10 further comprising a covered user interface sealing the user interface from the environment.

16. The medical grade stereo system of claim 15 further comprising a front face plate surrounding the user interface and sealing the housing interior from the environment.

17. A medical grade stereo system, comprising:

a housing including a front face plate and a rear plate;

a stereo receiver mounted into the housing for transmitting audio signals from a plurality of audio media devices;

a user interface mounted onto the front face plate for user operation of the stereo receiver;

a face plate cover mounted onto the user interface wherein the face plate cover seals the user interface from the environment;

a power supply mounted into the housing for supplying power to the stereo receiver and configured to limit current leakage from the stereo system to less than 300 microamperes;

a shielding enclosure surrounding the housing configured to limit radio frequency emissions from flowing out of the medical grade stereo system;

a plurality of audio component connectors mounted onto the housing each forming respective fully sealed interfaces with the housing for connecting auxiliary audio media players to the stereo receiver; and a shielded strain relief connector mounted on the rear plate forming a fully sealed interface at the rear plate.

* * * * *